US008166973B2

(12) United States Patent
Pan

(10) Patent No.: US 8,166,973 B2
(45) Date of Patent: May 1, 2012

(54) BREATHING APPARATUS STRUCTURE WITH TWO-STAGE REDUCED-PRESSURE SPARE AIR BOTTLE HEAD

(76) Inventor: Chieh-Cheng Pan, Taipei County (TW)

( * ) Notice: Subject to any disclaimer, the term of this patent is extended or adjusted under 35 U.S.C. 154(b) by 654 days.

(21) Appl. No.: 12/350,363

(22) Filed: Jan. 8, 2009

(65) Prior Publication Data

US 2010/0170515 A1 Jul. 8, 2010

(51) Int. Cl.
*A62B 9/02* (2006.01)

(52) U.S. Cl. ..... 128/205.24

(58) Field of Classification Search ..... 128/205.24
See application file for complete search history.

(56) References Cited

U.S. PATENT DOCUMENTS 4,192,298 A * 3/1980 Ferraro et al. ..... 128/205.24
4,996,982 A 3/1991 Williamson
6,901,958 B2 * 6/2005 Taylor ..... 137/614.2

* cited by examiner

*Primary Examiner* — Loan Thanh
*Assistant Examiner* — Peter S Vasat
(74) *Attorney, Agent, or Firm* — Rabin & Berdo, P.C.

(57) ABSTRACT

A breathing apparatus structure with a two-stage reduced-pressure spare air bottle head is provided, which includes an air bottle head mounted at an outlet end of a spare air bottle and an inhalation mouthpiece, so as to provide an air at a suitable pressure to a diver or drowning person for emergency use. The air bottle head is sequentially provided with an air bottle head switch, a high pressure reducing valve, and a low-pressure valve connected in series on an air passage thereof. Thus, an air leakage of a high-pressure air in the air bottle can be avoided when the high-pressure air is not used, and the service life of elastic elements of the low-pressure valve can also be prolonged.

8 Claims, 8 Drawing Sheets

BREATHING APPARATUS STRUCTURE WITH TWO-STAGE REDUCED-PRESSURE SPARE AIR BOTTLE HEAD

BACKGROUND OF THE INVENTION

1. Field of the Invention

The present invention relates to a breathing apparatus structure with a two-stage reduced-pressure spare air bottle head, and more particularly to a two-stage spare air bottle head structure having an air bottle head switch, a high pressure reducing valve, and a low-pressure valve, which can reduce the pressure of an high-pressure air in an air bottle when entering the low-pressure valve, so as to avoid the air leakage of the high-pressure air in the air bottle when not being used, thereby prolonging the service life of elastic elements of the low-pressure valve and achieving a desirable performance in usage.

2. Related Art

Generally, a conventional diver or life jacket (e.g., a life jacket of an aircraft pilot) is equipped with an air bottle spared for emergency use, which includes a spare air bottle, an air bottle head mounted at an outlet end of the air bottle and used for adjusting an air pressure, and an inhalation mouthpiece disposed in a manner of extending outwards from an regulator valve of the air bottle head, thereby being formed into a breather structure for providing an air at a suitable pressure to a diver or drowning person for emergency use.

As for conventional breathing apparatus structures with spare air bottle heads, for example, in a conventional structure (as shown in FIGS. 1-3) disclosed in U.S. Pat. No. 4,996,982, an air bottle head 60 mounted at an outlet end on the top of an air bottle 10 includes a body 601 and a housing 602. The body 601 is provided with a connector 61, a barometer 62, a safety bolt 63, a supply valve 64, a plug 65, and a regulator valve 66 thereon. Furthermore, a breathing chamber 603 in communication with an air outlet 661 of the regulator valve 66 is formed between an upper end of the body 601 and the housing 602. The housing 602 is provided thereon with a diaphragm 604 in contact with a pressing rod 662 of the regulator valve 66, and is further provided with an inhalation mouthpiece 70 in communication with the breathing chamber 603 on a sidewall thereof. In addition, the barometer 62, the safety bolt 63, and the supply valve 64 are respectively communicated with an air passage 611 of the connector 61 at a lower end of the body 601, communicated with a connecting hole of the plug 65 on one side via a connecting hole within the supply valve 64 (as shown in FIG. 3), and then communicated with a connecting hole of the regulator valve 66 via an air passage 651 within the connecting hole of the plug 65. The above conventional structure is characterized in that: a safety lock 641 is used to ensure that a valve 642 in the supply valve 64 is pressed against a closed position under an elastic force of a spring 643, so as to prevent the high-pressure air from flowing out of the air bottle 10 along an air passage 644; when the safety lock 641 is released to release the elastic force of the spring 643 in the supply valve 64, the valve 642 of the supply valve 64 is opened to allow the high-pressure air in the air bottle 10 to be delivered to the regulator valve 66 via the plug 65 and the passage 651 thereof. Afterwards, when a user inhales by using the inhalation mouthpiece 70 connected to an outer end of the breathing chamber 603 of the air bottle head, the diaphragm 604 on the housing 602 is used to press against the pressing rod 662 of the regulator valve 66 to open the regulator valve 66, thus enabling the air in the air bottle 10 to be delivered to the inhalation mouthpiece 70 for breathing use.

The structure disclosed in U.S. Pat. No. 4,996,982 has the following disadvantages. 1. The valve 642 in the supply valve 64 is pressed under the forces of the safety lock 641 and the spring 643, so as to prevent the high-pressure air from flowing out of the air bottle 10. However, when the high-pressure air at a pressure of about 3000 psi applies a pressure to the spring 643 continuously for a long time, an elastic fatigue easily occurs to the spring 643, and the high-pressure air may also directly enter the regulator valve 66 and cause an elastic fatigue of a spring 663 in the regulator valve 66, thereby resulting in element damage, air leakage, as well as reduction of the service life of the spare air bottle. 2. When the supply valve 64 is opened to allow the high-pressure air in the air bottle to flow into the regulator valve 66, it may also result in an elastic fatigue of the spring 663 in the regulator valve 66, and the service life and throttling effect of the regulator valve 66 are also influenced. 3. When the air in the air bottle 10 is insufficient or has been used up, the air bottle 10 cannot be reused since an air cannot be supplemented into the air bottle 10, thereby resulting in a waste of resources.

The above structure also has other disadvantages. Referring to FIG. 1, the inhalation mouthpiece 70 is perpendicularly protruded from a sidewall surface of the air bottle head 60. Thus, in practice, when a user keeps the inhalation mouthpiece 70 in mouth for use, the body of the air bottle 10 is too close to the breast of the user and thus affects the user in lowering the head, which fails to meet the ergonomic requirements and hinders the use. Referring to FIG. 2, the safety bolt 63 is disposed within the breathing chamber 603 of the air bottle head 60. Thus, when the temperature or air pressure of the air bottle exceeds a threshold value and an adjustment needs to be performed to avoid bursting of the air bottle, the diaphragm 604 on the housing 602 needs to be dissembled in order to perform the adjustment, thereby causing great inconvenience and even safety risks if the pressure cannot be adjusted in real time.

In consideration of the disadvantages of the above conventional breathing apparatus structure with a spare air bottle head in terms of structure and use, the conventional structure can be further improved and needs to be further improved. Through profound studies and based on years of personal experiences in manufacturing and designing in this field, the inventor eventually works out a novel breathing apparatus structure with a two-stage reduced-pressure spare air bottle head.

SUMMARY OF THE INVENTION

Accordingly, the present invention is mainly directed to a breathing apparatus structure with a two-stage reduced-pressure spare air bottle head, in which a high-pressure air that flows from an air bottle into a breathing chamber sequentially passes through an air bottle head switch, a high pressure reducing valve, and a low-pressure valve, so as to facilitate the control and effectively provide an air at a suitable pressure for use, and supplement an air into the air bottle to enable the air bottle to be reused.

The present invention is also directed to a breathing apparatus structure with a two-stage reduced-pressure spare air bottle head, in which a high-pressure air in an air bottle is completely blocked by an air bottle head switch, so as to avoid unnecessary air leakage, thereby prolonging the service life of the spare air bottle.

The present invention is further directed to a breathing apparatus structure with a two-stage reduced-pressure spare air bottle head, in which an air bottle head switch is used to block a high-pressure air in an air bottle, so as to prevent a high pressure reducing valve from being subjected to a pressure continuously for a long time and thus avoid an elastic fatigue of the springs therein. Furthermore, the high pressure reducing valve is also used to reduce the pressure, so as to prevent a low-pressure valve from being directly subjected to the pressure of the high-pressure air and further avoid the elastic fatigue of the springs therein, thereby prolonging the service life of the high pressure reducing valve and the low-pressure valve.

The present invention is further directed to a breathing apparatus structure with a two-stage reduced-pressure spare air bottle head, in which a safety bolt is disposed perpendicular to a side surface of a body of an air bottle head and protruding there-from for the ease of operation, and a screen is disposed between an outlet end of an air bottle and a connector of the air bottle head to provide clean air and prevent impurities from entering the air bottle to damage the elements.

The present invention is further directed to a breathing apparatus structure with a two-stage reduced-pressure spare air bottle head, in which an inhalation mouthpiece on one side of a housing of an air bottle head is designed to be inclined upwards by a certain angle for the ease of use.

In order to achieve the above objectives, the present invention provides a breathing apparatus structure with a two-stage reduced-pressure spare air bottle head, which includes an air bottle head mounted at an outlet end of a spare air bottle and used for adjusting an air pressure, and an inhalation mouthpiece disposed in a manner of extending outwards from a low-pressure valve of the air bottle head, so as to provide an air at a suitable pressure to a diver or drowning person for emergency use. The air bottle head is mainly provided thereon with a connector, an air-filling head, a safety bolt, an air bottle head switch, a high pressure reducing valve, and a low-pressure valve. The air bottle head switch, the high pressure reducing valve, and the low-pressure valve are sequentially disposed and connected in series on an air passage of the air bottle head for connecting the outlet end of the air bottle and the inhalation mouthpiece.

In the above structure, the connector is protruded downwards from a bottom of the air bottle head and is threaded to the outlet end of the air bottle.

The air-filling head is screwed to a connecting hole on one side surface of the air bottle head, in which the connecting hole is provided with a passage at a center thereof, and the passage is in communication with a passage in the connector.

The safety bolt is screwed to a connecting hole on one side surface of the air bottle head close to one side of the air-filling head, in which the connecting hole is provided with a passage at a center thereof, and the passage is in communication with the passage in the connector.

The air bottle head switch is screwed to a connecting hole on one side surface of the air bottle head close to the other side of the air-filling head, in which the connecting hole is provided with a first passage and a second passage therein. Particularly, the first passage is located at an eccentric position of the connecting hole and is in communication with the passage of the connector, and the second passage is located at a center of the connecting hole, which is plugged upon being pressed against by a threaded plug at an inner end of the air bottle head switch, and is opened or closed by rotating an operating rod to loosen or tighten the threaded plug.

The high pressure reducing valve is disposed on a connecting hole of the air bottle head between the air bottle head switch and the safety bolt, in which the connecting hole is provided with a first passage and a second passage therein. Particularly, the first passage is located at a center of the connecting hole, and is in communication with the second passage of the air bottle head switch, which is opened or closed under the control of a piston of the high pressure reducing valve. The second passage is located at an eccentric position of the connecting hole.

The low-pressure valve is screwed to a connecting hole on a top surface of the air bottle head and is in communication with the second passage of the high pressure reducing valve, and has a pressing rod for controlling a piston of the low-pressure valve to be opened or closed.

With the above structure of the present invention, the air bottle head switch is turned off to block the high-pressure air in the air bottle from entering the high pressure reducing valve, thus avoiding an air leakage of the high-pressure air in the air bottle when the high-pressure air is not used. In addition, when the air bottle head switch is turned on, the pressure of the high-pressure air in the air bottle is firstly reduced through the high pressure reducing valve, and then the high-pressure air enters the low-pressure valve, which is ready for breathing use. Therefore, elastic elements within the high pressure reducing valve and the low-pressure valve will not be subjected to the pressure of the high-pressure air for a long time, thereby prolonging the service life of the elastic elements of the high pressure reducing valve and the low-pressure valve, achieving the optimal performance, and further bringing other convenient subordinate efficacies in usage.

DETAILED DESCRIPTION OF THE INVENTION

Figure 2:
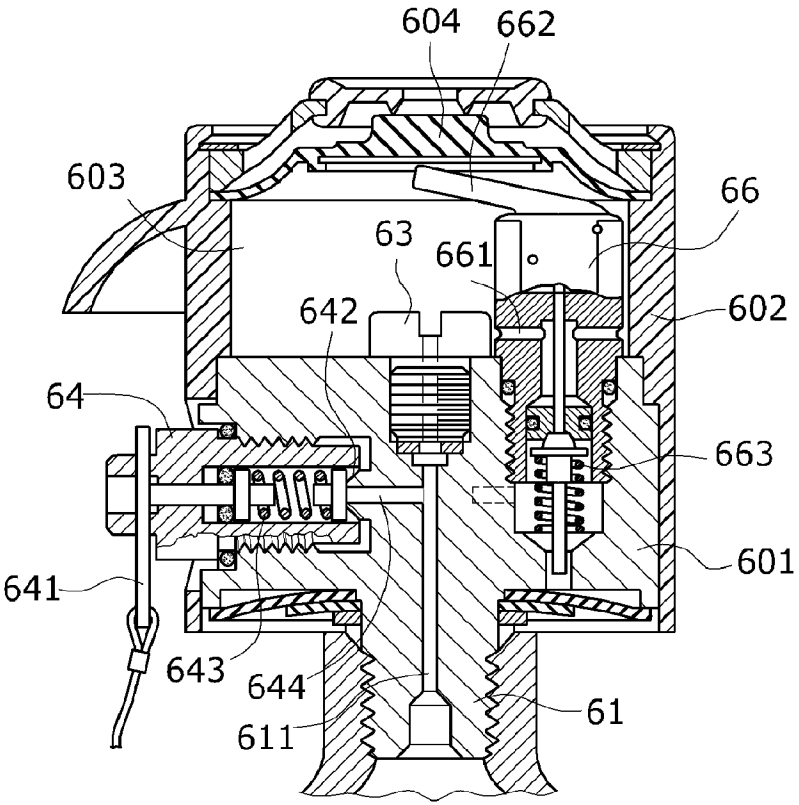
Fig.2 (PRIOR ART)
FIG. 2 is an assembled cross-sectional view of the conventional structure.
Figure 1:
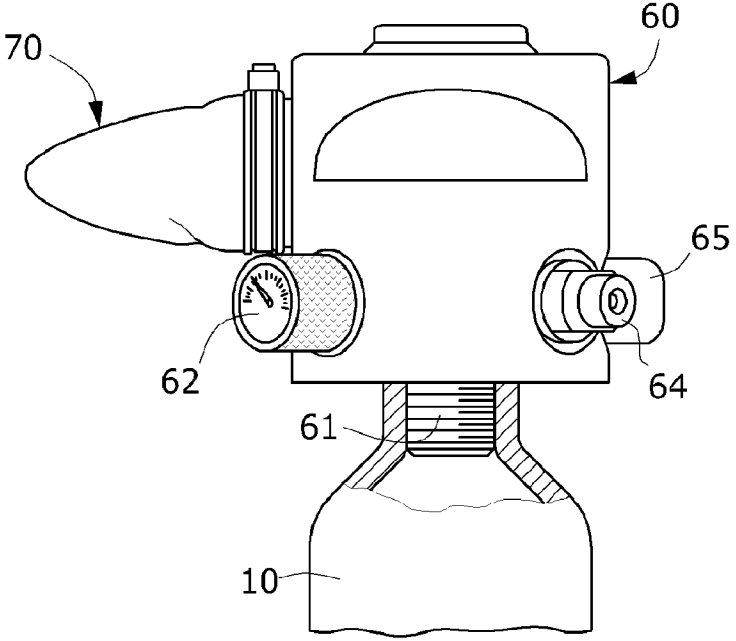
Fig.1 (PRIOR ART)
FIG. 1 is a schematic assembled view of a conventional structure.
Figure 3:
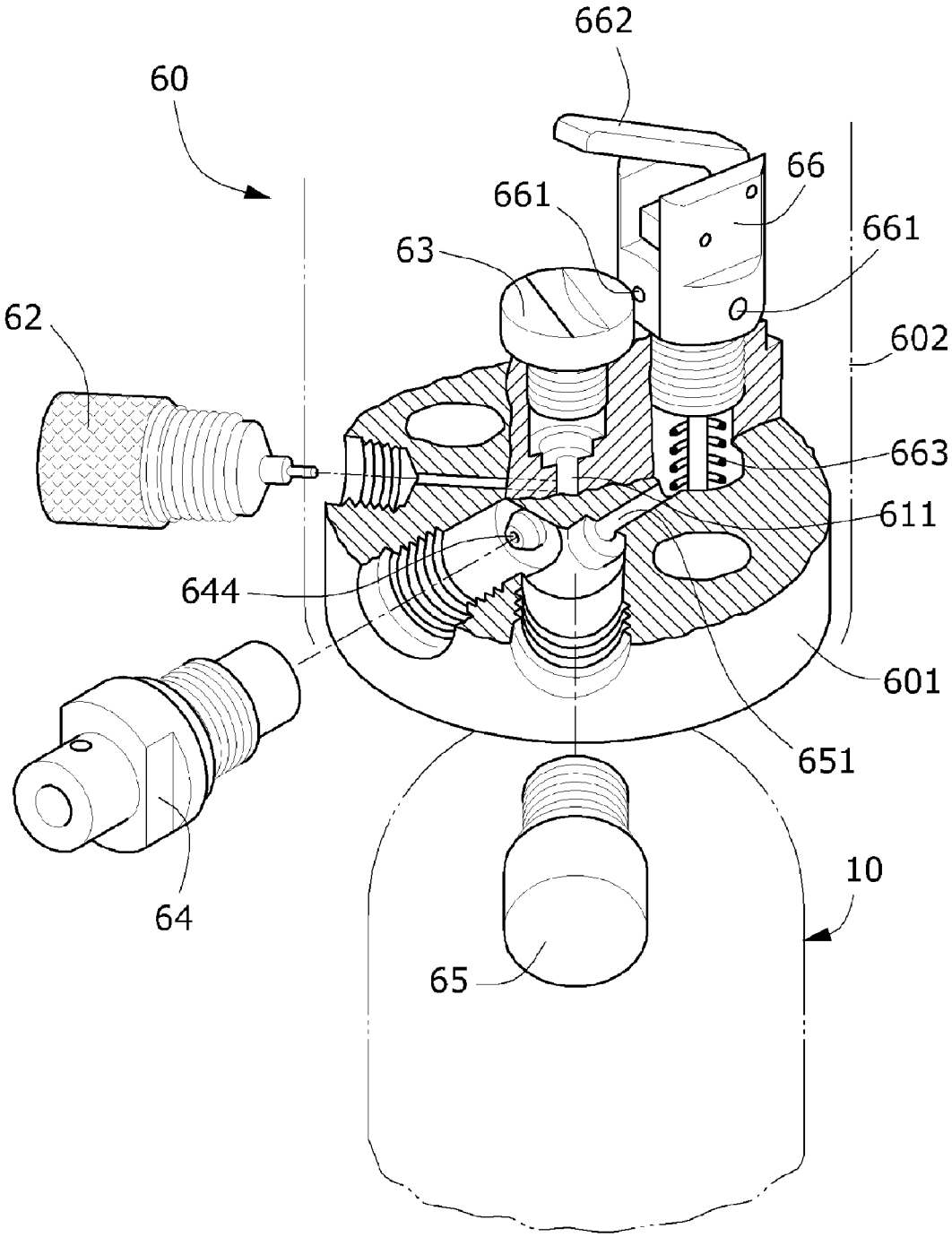
Fig.3 (PRIOR ART)
FIG. 3 is a three-dimensional exploded cross-sectional view of the conventional structure.

In order to make the structures, apparatuses, and features of the present invention more comprehensible, the preferred embodiments of the present invention are described in detail below with reference to the accompanying drawings.

Referring to FIGS. 4-7, a breathing apparatus structure with a two-stage reduced-pressure spare air bottle head according to an embodiment includes: an air bottle head 20 mounted at an outlet end of a spare air bottle 10 and used for adjusting an air pressure, and an inhalation mouthpiece 30 disposed in a manner of extending outwards from a low-pressure valve 26 of the air bottle head 20, so as to provide an air at a suitable pressure to a diver or drowning person for emergency use. The air bottle head 20 is mainly provided with a connector 21, an air-filling head 22, a safety bolt 23, an air bottle head switch 24, a high pressure reducing valve 25, and a low-pressure valve 26 thereon. The air bottle head switch 24, the high pressure reducing valve 25, and the low-pressure valve 26 are sequentially disposed and connected in series on an air passage of the air bottle head 20 for connecting the outlet end of the air bottle 10 to the inhalation mouthpiece 30.

Figure 5:
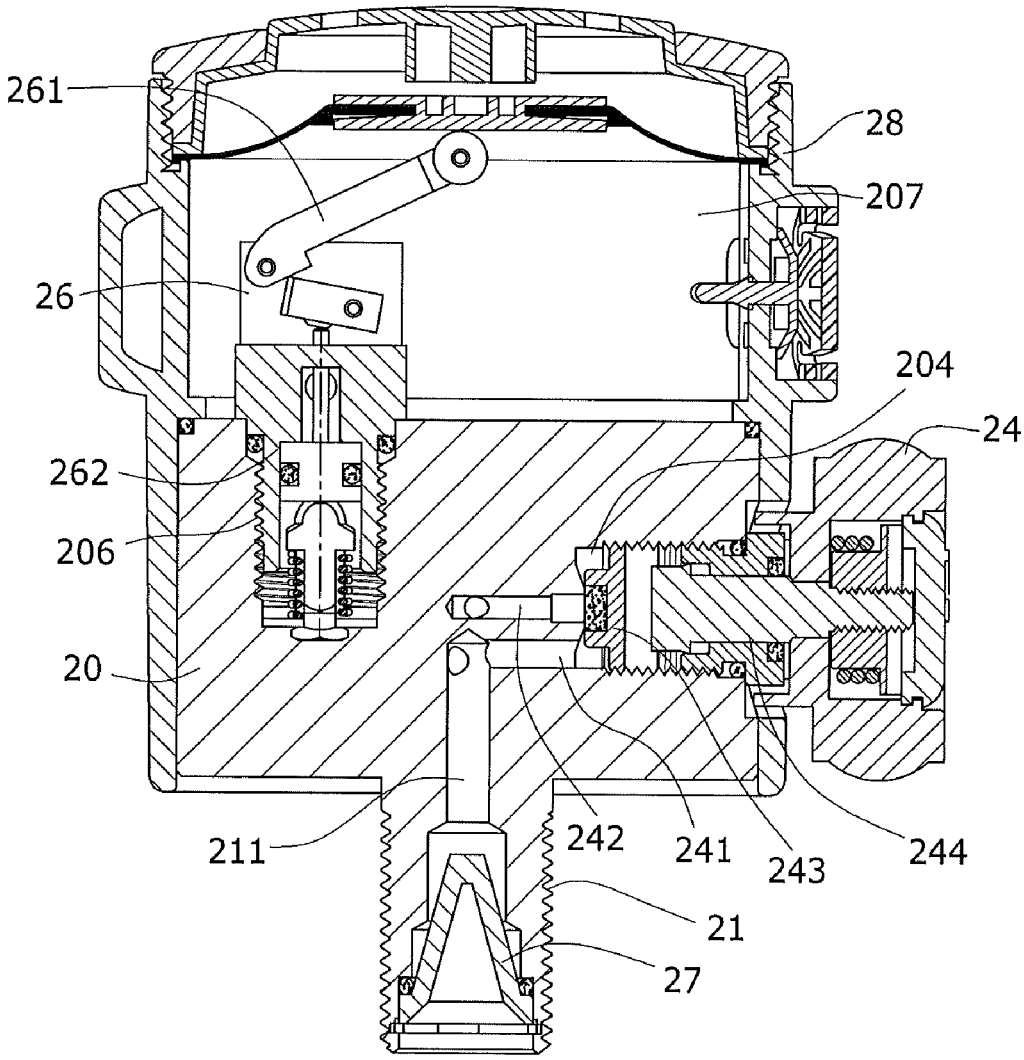
FIG. 5 is an assembled cross-sectional view of the embodiment of FIG. 4.

As known from the above structure and embodiment, the connector 21 is protruded downwards from a bottom of the air bottle head 20 and is threaded to the outlet end of the air bottle 10, and a screen 27 is disposed between the connector 21 and the outlet end of the air bottle 10 (as shown in FIG. 5).

Figure 6:
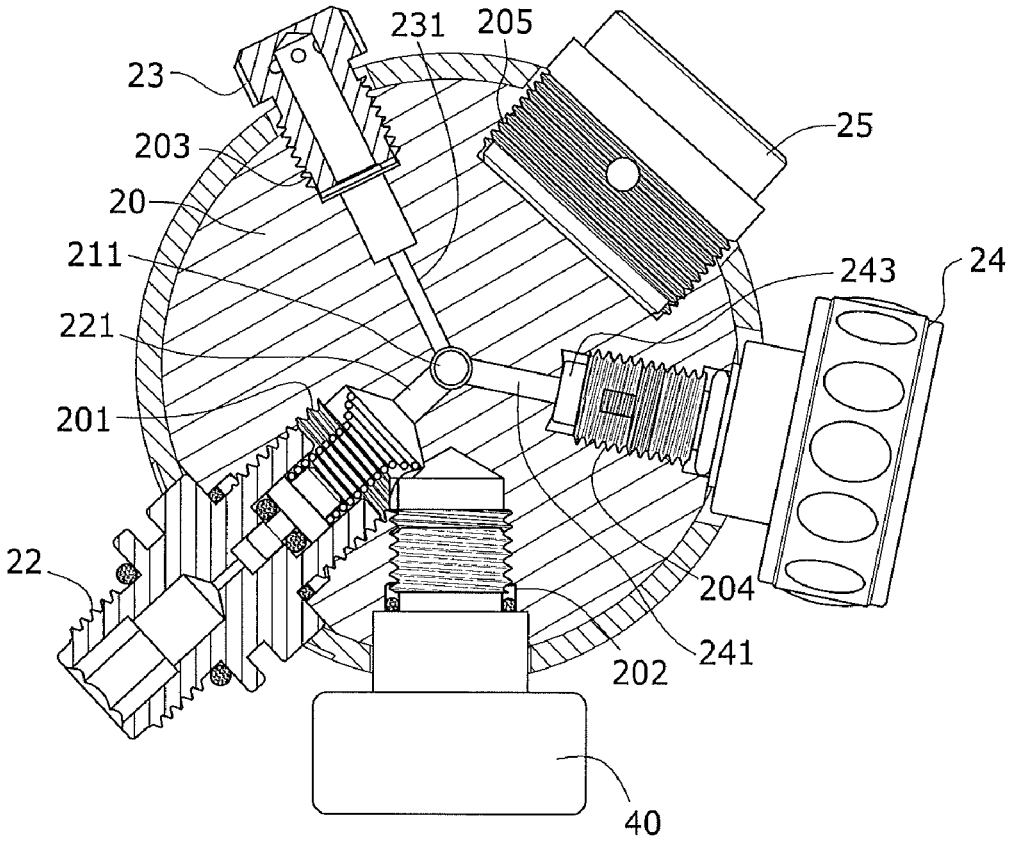
FIG. 6 is a cross-sectional view of the embodiment of FIG. 5 taken along a line A-A.

The air-filling head 22 is screwed to a connecting hole 201 on one side surface of the air bottle head 20 (as shown in FIG. 6). The connecting hole 201 is provided with a passage 221 at a center thereof, and the passage 221 is in communication with a passage 211 in the connector 21, so that the structure is enabled to be reused by supplementing air and is more practical since the air is supplemented without passing through the air bottle head switch 24. In addition, in this embodiment, a barometer 40 is provided on one side of the air-filling head 22 and screwed to a connecting hole 202 of the air bottle head 20. The connecting hole 202 is in communication with the connecting hole 201 of the air-filling head 22, so as to monitor the air pressure in the air bottle 10 at any time.

The safety bolt 23 is screwed to a connecting hole 203 on one side surface of the air bottle head 20 close to one side of the air-filling head 22, in which the connecting hole 203 is provided with a passage 231 at a center thereof, and the passage 231 is in communication with the passage 211 in the connector 21 (as shown in FIG. 6). As such, when the air pressure in the air bottle 10 is too high, the pressure can be immediately adjusted and reduced, so as to prevent the air bottle 10 from bursting.

Figure 7:
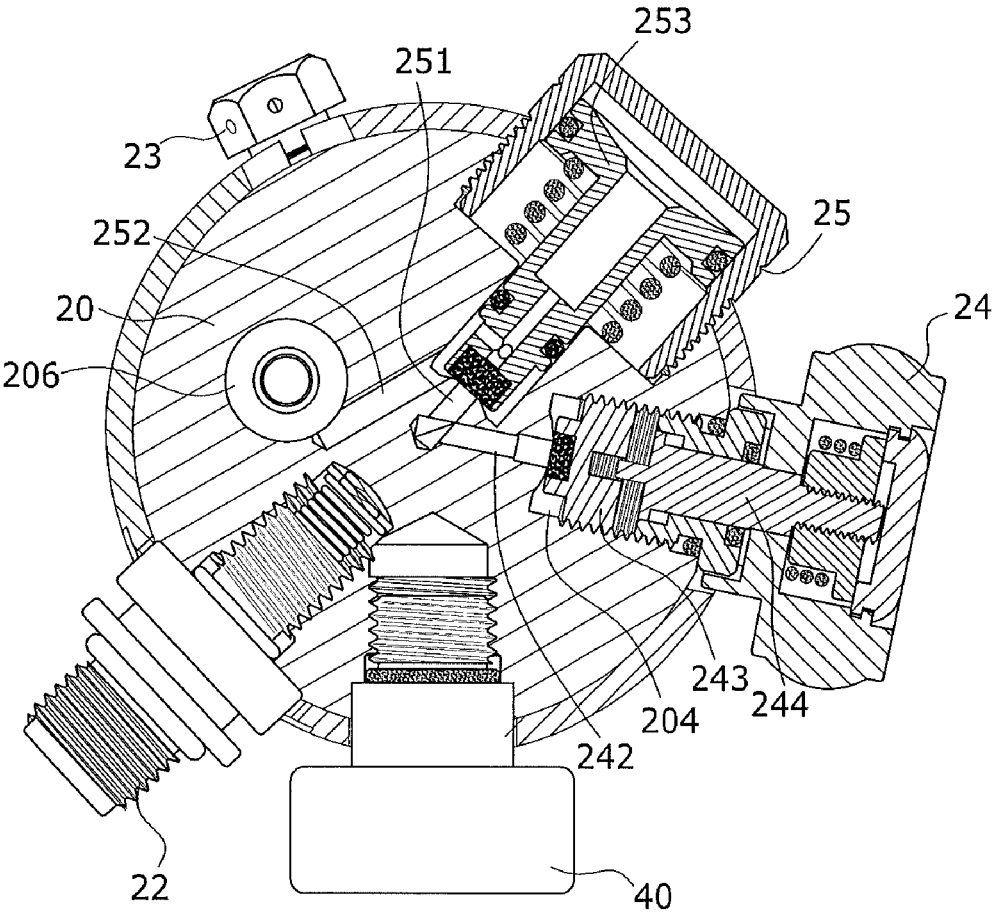
FIG. 7 is a cross-sectional view of the embodiment of FIG. 5 taken along a line B-B.

The air bottle head switch 24 is screwed to a connecting hole 204 on one side surface of the air bottle head 20 close to the other side of the air-filling head 22, in which the connecting hole 204 is provided with a first passage 241 and a second passage 242 therein (as shown in FIGS. 5 and 7). The first passage 241 is located at an eccentric position (at a lower part) of the connecting hole 204 and is in communication with the passage 211 of the connector 21. The second passage 242 is located at a center of the connecting hole 204, which is plugged upon being pressed against by a threaded plug 243 at an inner end of the air bottle head switch 24, and is opened or closed by rotating an operating rod 244 to loosen or tighten the threaded plug 243.

The high pressure reducing valve 25 is disposed on a connecting hole 205 of the air bottle head between the air bottle head switch 24 and the safety bolt 23, in which the connecting hole 205 is provided with a first passage 251 and a second passage 252 therein (as shown in FIG. 7). The first passage 251 is located at a center of the connecting hole 205 and is in communication with the second passage 242 of the air bottle head switch 24, which is opened or closed under the control of a piston 253 of the high pressure reducing valve 25. The second passage 252 is located at an eccentric position of the connecting hole 205.

The low-pressure valve 26 is screwed to a connecting hole 206 on a top surface of the air bottle head 20 and is in communication with the second passage 252 of the high pressure reducing valve 25 (as shown in FIG. 7), and has a pressing rod 261 in contact with a diaphragm above a housing 28 of the air bottle head (as shown in FIG. 5) for controlling a piston 262 of the low-pressure valve 26 to be opened or closed.

Figure 4:
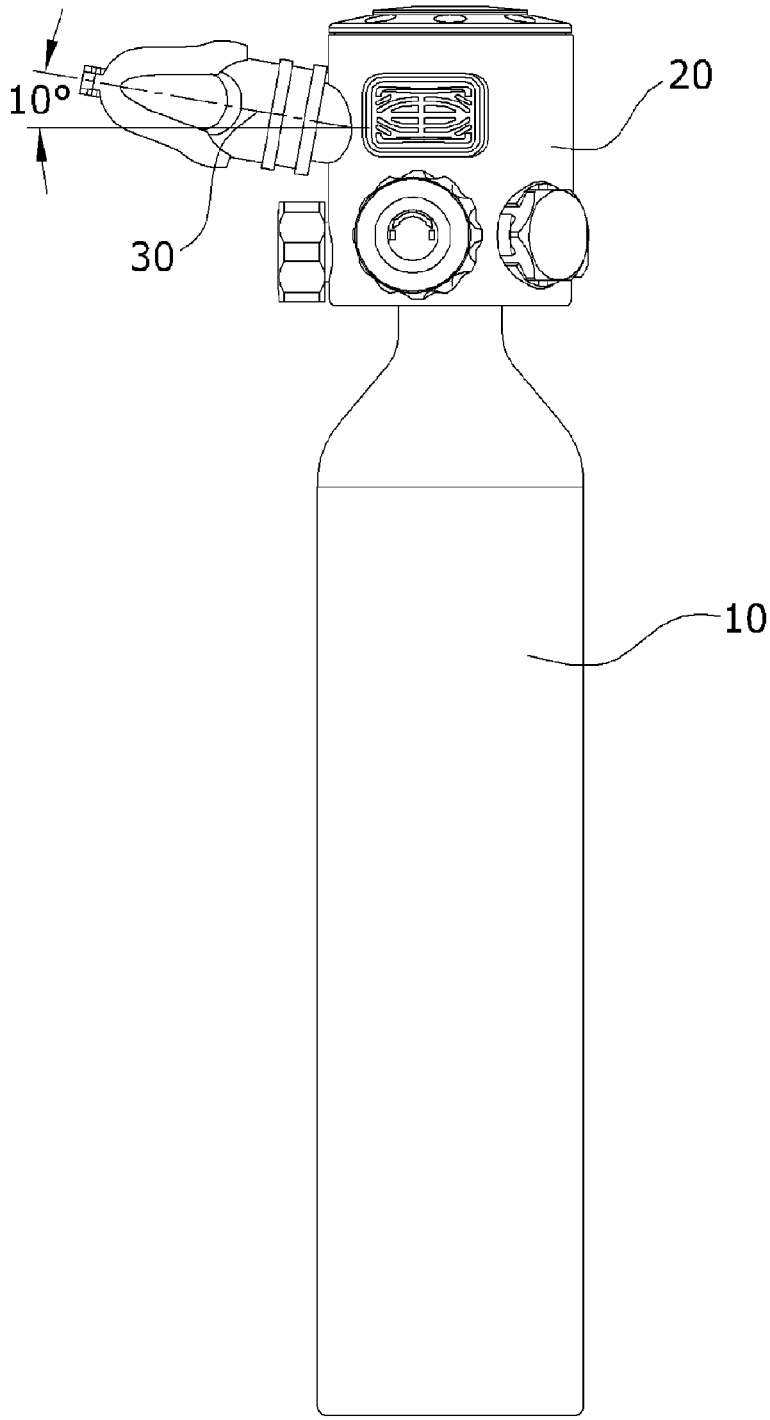
FIG. 4 is an assembled plane view of an embodiment of the present invention.
Figure 8:
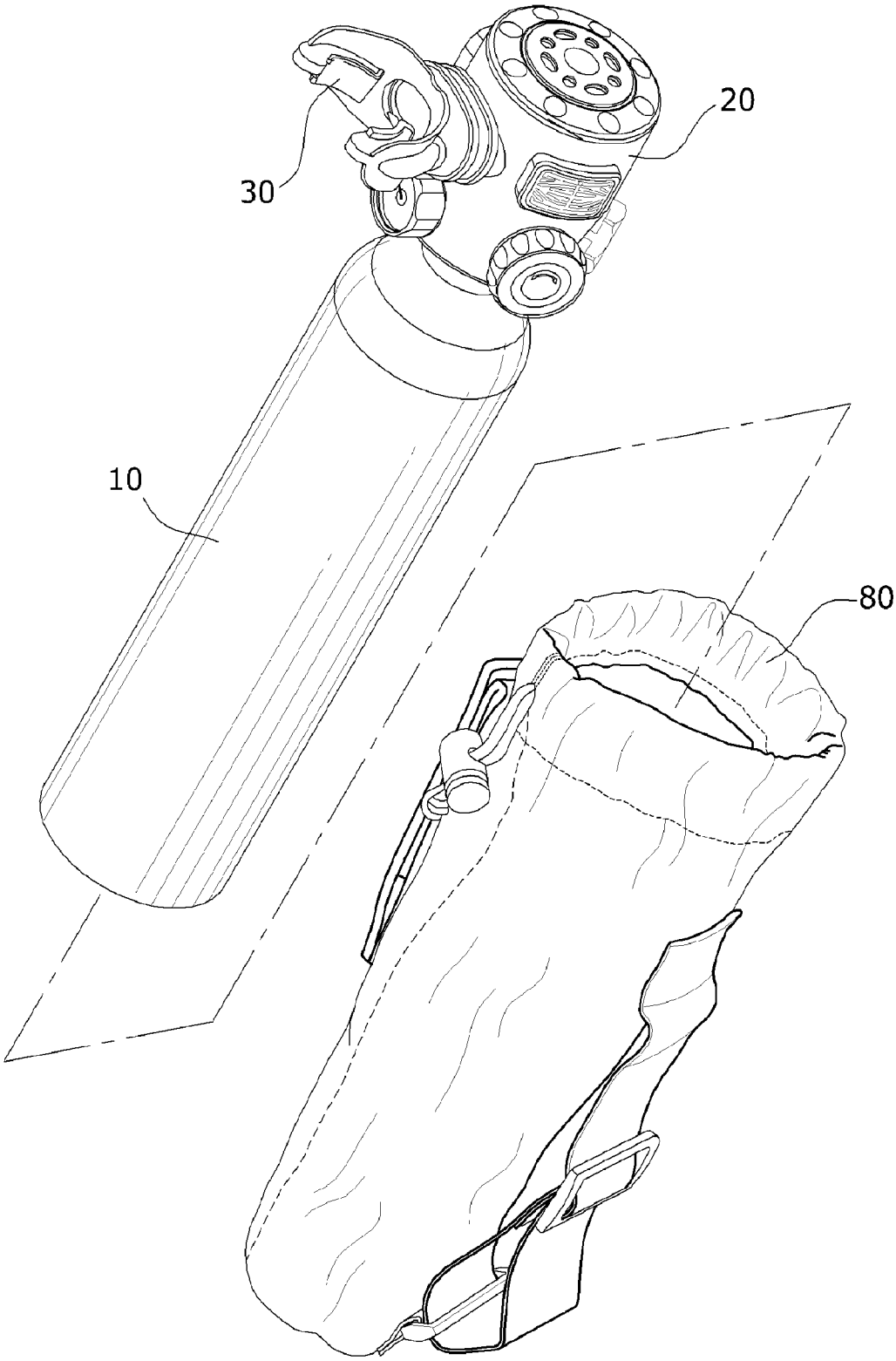
FIG. 8 is a three-dimensional schematic view of the embodiment of FIG. 4.

Referring to FIGS. 4 and 5, in this embodiment, the housing 28 is provided on the air bottle head 20, such that the low-pressure valve 26 is wrapped in the housing 28 to form a breathing chamber 207. The inhalation mouthpiece 30 is protruded outwards from a sidewall surface of the housing 28 and inclined upwards (preferably inclined by about 10°), which is in communication with the breathing chamber 207, and thus the inhalation mouthpiece 30 has a preferred ergonomic design and is thus convenient for a user to keep it in mouth for use. Furthermore, as shown in the above embodiment, a configuration that the inhalation mouthpiece 30 is directly attached to the air bottle head 20 on a top end of the air bottle 10 is a small spare air bottle apparatus, and thus, such structure can be placed in a bag 80 (as shown in FIG. 8), which is convenient for being carried along and placed in practice.

Figure 9:
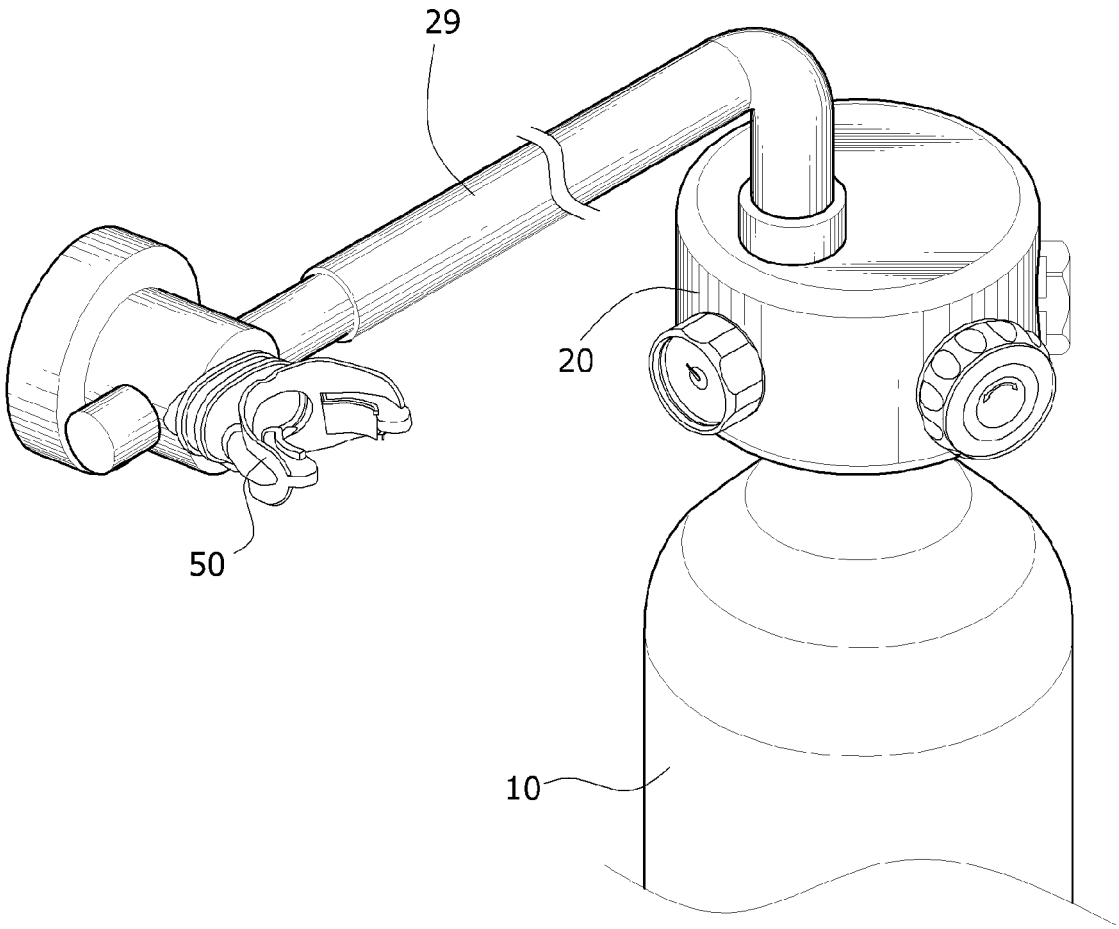
FIG. 9 is a schematic assembled view of another embodiment of the present invention.

In another embodiment shown in FIG. 9, the present invention may also be configured as follows: an extension pipe 29 extends from a top surface of the air bottle head 20 to an external inhalation mask 50, and the inhalation mask 50 is also formed therein with a breathing chamber equivalent to that shown in FIG. 5, a low-pressure valve within the breathing chamber, and an inhalation mouthpiece in communication with the breathing chamber (internal structures are omitted in FIG. 9).

With the above structure of the present invention, a handle is used to rotate the operating rod 244 to tighten the threaded plug 243 of the air bottle head switch 24 to press against the second passage 242, so as to block the high-pressure air in the air bottle 10 from entering the high pressure reducing valve 25 via the second passage 242, thereby avoiding an air leakage of the high-pressure air in the air bottle 10 via the high pressure reducing valve 25 when the high-pressure air is not used. In addition, when the air bottle head switch 24 is turned on, the high-pressure air in the air bottle 10 firstly enters the high pressure reducing valve 25 via the second passage 242 of the air bottle head switch 24 and the first passage 251 of the high pressure reducing valve 25 for a first pressure reduction, and then enters the low-pressure valve 26 via the second passage 252 of the high pressure reducing valve 25, which is ready for breathing use. Thus, the high-pressure air can be completely blocked from leaking via the air bottle head switch 24 in the present invention. Therefore, elastic elements within the high pressure reducing valve 25 and the low-pressure valve 26 will not be subjected to the pressure of the high-pressure air for a long time, so that the service life of the elastic elements of the high pressure reducing valve 25 and the low-pressure valve 26 is prolonged. Moreover, unnecessary air leakage can be avoided when the high-pressure air is not being used, thus prolonging the service life of the spare air bottle.

Referring to FIG. 6, in the present invention, the safety bolt 23 is disposed in a manner of being perpendicular to and protruded from a side surface of a body of the air bottle head 20, so as to eliminate the disadvantage of a conventional structure with a safety bolt disposed within a housing of the air bottle head, thus facilitating the operation. A screen 27 is disposed between the outlet end of the air bottle 10 and the connector 21 of the air bottle head 20 (as shown in FIG. 5) for filtering impurities, so as to provide clean air and protect the elements.

The above embodiments of the breathing apparatus structure with the two-stage reduced-pressure spare air bottle head are only two feasible embodiments among a number of feasible embodiments, so the scope of the present invention is not limited thereto. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

In view of the above, the present invention, entitled "breathing apparatus structure with two-stage reduced-pressure spare air bottle head", can indeed achieve the anticipated objectives and efficacies of the present invention. Also, no identical items or techniques has been published or used before the present invention is applied, so the present invention meets the patent requirements. Therefore, the applicant files for a utility model patent according to the provisions of the Patent Act.

What is claimed is:

1. A breathing apparatus structure with a two-stage reduced-pressure spare air bottle head structure, mounted on an outlet end of a spare air bottle, comprising:

an air bottle head having a bottom protruding downwards to mount a connector, the connector being threaded to an outlet of the spare air bottle, a bottom passage being axially mounted inside the connector, an inhalation mouthpiece being disposed in a manner of extending outwards from the air bottle head, a plurality of connecting holes being mounted on a top and a lateral side of the air bottle head, the plurality of connecting holes being in communication with a plurality of passages;

an air-filling head, screwed to a first connecting hole on one lateral side of the air bottle head, the first connecting hole being provided with an air-filling passage at a center thereof, the air-filling passage being in communication with the bottom passage in the connector;

a safety bolt, threaded to a second connecting hole on one lateral side of the air bottle head close to one side of the air-filling head, a center of the second connecting hole being provided with a safety bolt passage, which is in communication with the bottom passage in the connector, an air bottle head switch, screwed to a third connecting hole on one lateral side of the air bottle head close to one side of the air-filling head, the third connecting hole being provided with a first passage and a second passage therein and being plugged upon being pressed against by a threaded plug formed at an inner end of the air bottle head switch, the first passage being located at an eccentric position of the third connecting hole and being in communication with the bottom passage in the connector, the second passage being located at a center of the third connecting hole and being opened or closed by rotating an operating rod of a rear side of the air bottle head switch to loosen or tighten the threaded plug;

a high pressure reducing valve, disposed on a fourth connecting hole of the air bottle head between the air bottle head switch and the safety bolt, the fourth connecting hole being provided with a third passage and a fourth passage therein, the third passage being located at a center of the fourth connecting hole and in communication with the second passage of the air bottle head switch, the third passage being opened or closed under the control of a piston of the high pressure reducing valve, the fourth passage being located at an eccentric position of the fourth connecting hole; and a low-pressure valve, screwed to a fifth connecting hole on a top surface of the air bottle head, the low-pressure valve being in communication with the fourth passage of the high pressure reducing valve and having a pressing rod for controlling a piston of the low-pressure valve to be opened or closed, wherein the air bottle head switch, the high pressure reducing valve and the low-pressure valve are sequentially disposed and connected in series on an air passage of the air bottle head for connecting the outlet end of the air bottle to the inhalation mouthpiece.

2. The breathing apparatus structure with a two-stage reduced-pressure spare air bottle head structure according to claim 1, wherein a screen is disposed between the outlet end of the air bottle and the connector of the air bottle head.

3. The breathing apparatus structure with a two-stage reduced-pressure spare air bottle head structure according to claim 1, wherein a housing of the air bottle head is provided on the air bottle head to wrap the low-pressure valve therein to form a breathing chamber, and the inhalation mouthpiece is protruded outwards from a sidewall surface of the air bottle head housing and is inclined upwards and is in communication with the breathing chamber.

4. The breathing apparatus structure with a two-stage reduced-pressure spare air bottle head structure according to claim 3, wherein the inhalation mouthpiece is inclined upwards by 10°.

5. The breathing apparatus structure with a two-stage reduced-pressure spare air bottle head structure according to claim 1, wherein a barometer is provided on one side of the air-filling head and screwed to a sixth connecting hole of the air bottle head, and the sixth connecting hole is in communication with the first connecting hole to which the air-filling head is screwed.

6. The breathing apparatus structure with a two-stage reduced-pressure spare air bottle head structure according to claim 1, wherein the high pressure reducing valve is disposed on the fourth connecting hole on one lateral side of the air bottle head.

7. The breathing apparatus structure with a two-stage reduced-pressure spare air bottle head structure according to claim 1, wherein the operating rod is rotated by a handle to tighten the threaded plug of the air bottle head switch to press against the second passage to block high-pressure air in the air bottle from entering the high pressure reducing valve via the second passage, so that an air leakage of the high-pressure air is avoided in the air bottle via the high pressure reducing valve when the high-pressure air is not used.

8. The breathing apparatus structure with a two-stage reduced-pressure spare air bottle head structure according to claim 1, wherein when the second passage is opened, the opened second passage allows high-pressure air in the air bottle to firstly enter the high pressure reducing valve via the second passage of the air bottle head switch and the first passage of the high pressure reducing valve for a first pressure reduction, and then to enter the low-pressure valve via the fourth passage of the high pressure reducing valve, which is ready for breathing use.

* * * * *